US008220473B1

(12) United States Patent
Chang

(10) Patent No.: US 8,220,473 B1
(45) Date of Patent: Jul. 17, 2012

(54) FOLDABLE UMBRELLA CAPABLE OF AUTO-ADJUSTMENT OF THE UMBRELLA CLOTH

(76) Inventor: Han-Hsiang Chang, Taoyuan Hsien (TW)

( * ) Notice: Subject to any disclaimer, the term of this patent is extended or adjusted under 35 U.S.C. 154(b) by 17 days.

(21) Appl. No.: 12/978,643

(22) Filed: Dec. 27, 2010

(51) Int. Cl.
*A45B 25/18* (2006.01)

(52) U.S. Cl. ..... 135/33.4; 135/25.32; 135/27

(58) Field of Classification Search ..... 135/15.1, 135/20.1, 25.31–25.32, 25.34, 27, 33.2–33.41
See application file for complete search history.

(56) References Cited

U.S. PATENT DOCUMENTS

| | | | | |
|---|---|---|---|---|
| 792,737 | A * | 6/1905 | Smith | 135/33.2 |
| 4,007,753 | A * | 2/1977 | DeMarco | 135/25.33 |
| 5,131,422 | A * | 7/1992 | Aronov | 135/27 |
| 5,213,123 | A * | 5/1993 | Whitfield | 135/27 |
| 5,235,997 | A * | 8/1993 | Good | 135/25.3 |
| 5,305,771 | A * | 4/1994 | Wilk | 135/31 |
| 5,640,984 | A * | 6/1997 | Dubunsky | 135/33.2 |
| 6,164,304 | A * | 12/2000 | Headley | 135/34.2 |
| 6,302,125 | B1 * | 10/2001 | Lin et al. | 135/33.2 |
| 7,806,131 | B1 * | 10/2010 | Seiler | 135/33.2 |
| 2007/0125409 | A1 * | 6/2007 | Cullen | 135/33.41 |
| 2010/0307548 | A1 * | 12/2010 | Cain et al. | 135/20.1 |

FOREIGN PATENT DOCUMENTS

| | | | |
|---|---|---|---|
| JP | 2000312609 | A * | 11/2000 |
| JP | 2010099422 | A * | 5/2010 |

* cited by examiner

*Primary Examiner* — Winnie Yip

(57) ABSTRACT

A foldable umbrella capable of auto-adjustment of the umbrella cloth comprises: a plurality of foldable ribs; an umbrella pole for connecting one ends of the ribs; an umbrella cloth expanded along a space spanned by the ribs; at least one connection portion located on an inner side of the umbrella cloth and two adjacent ribs. Each connection portion includes two L-shaped retainers and one connecting unit; and each L-shaped retainer is made of flexible and bendable material. When the umbrella is folded, by the clamping effect of the two L-shaped retainers of one connection portion, the umbrella cloth will present a smooth folded shape so that the umbrella cloth is folded along the umbrella pole easily. Thus the umbrella cloth can be folded easily, rapidly, and directly with a beautiful outlook and a small size. It is difficult to be damaged.

10 Claims, 3 Drawing Sheets

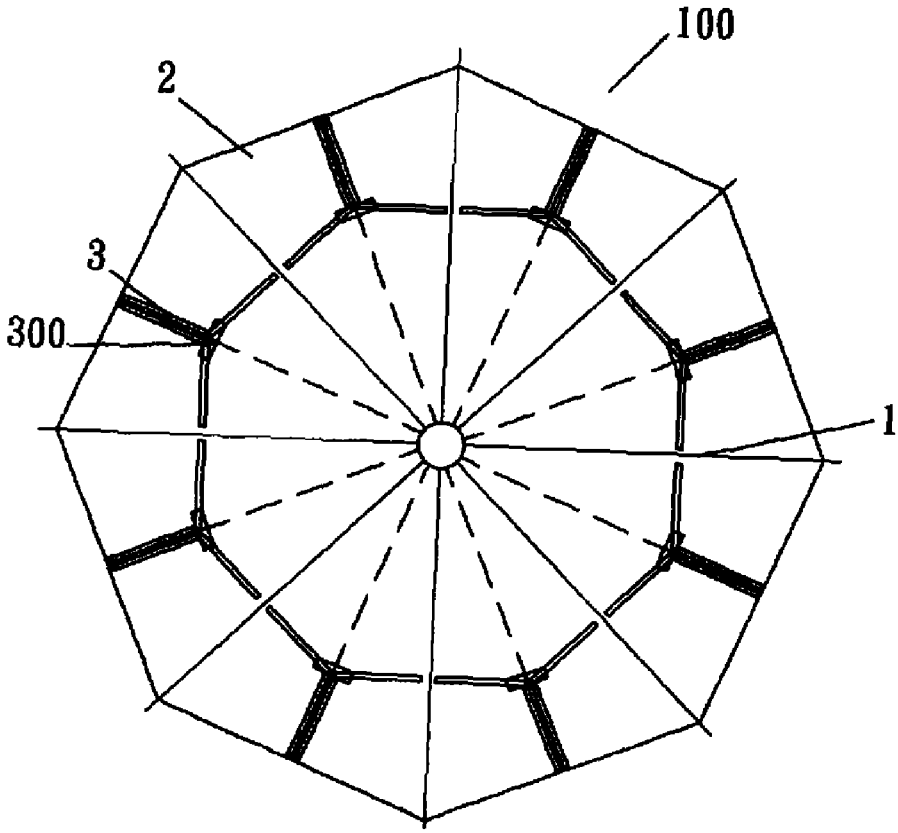
Fig 1
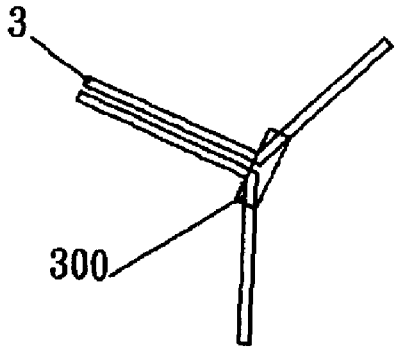
Fig 1.1

FOLDABLE UMBRELLA CAPABLE OF AUTO-ADJUSTMENT OF THE UMBRELLA CLOTH

FIELD OF THE INVENTION

The present invention relates to umbrellas, in particular to a foldable umbrella capable of auto-adjustment of the umbrella cloth thereof.

BACKGROUND OF THE INVENTION

In the prior art foldable umbrella, the ribs are folded for storage, but in the meantime, the umbrella cloth is not guided properly so that the cloth is not folded regularly. As a result, the folded umbrella presents an irregular and messy outlook. The users often have to take time to adjust the umbrella cloth for making the folded umbrella has a beautiful outlook with a small size and can be retained safely without being damaged. However, this is time-consuming and thus, the users would rather let the umbrella cloth be irregular than to take time to adjust the umbrella cloth.

Therefore, there is an eager demand for a novel design which can improve the prior art defects so that after the umbrella is folded, it will have a smooth outlook. Furthermore, the umbrella cloth can be folded easily, rapidly, and directly with a beautiful and smooth outlook and a small size, while at the same time, it is difficult to be damaged.

SUMMARY OF THE INVENTION

The object of the present invention is to resolve the above mentioned problems in the prior art. In the present invention, a foldable umbrella capable of auto-adjustment of the umbrella cloth thereof is a provided. When the user folds the umbrella, by the clamping and shape effect of the two L-shaped retainers, the umbrella cloth will present an apparent folding edges and have a smooth outlook so that the umbrella cloth is folded along the umbrella pole easily. Thus the umbrella cloth can be folded easily, rapidly, and directly with a beautiful outlook and a small size. It is difficult to be damaged.

To achieve above object, the present invention provides a foldable umbrella capable of auto-adjustment of the umbrella cloth thereof, comprising: a plurality of foldable ribs; an umbrella pole for connecting one ends of the ribs; an umbrella cloth expanded along a space spanned by the ribs; at least one connection portion located on an inner side of the umbrella cloth and two adjacent ribs; and wherein each connection portion includes two L-shaped retainers and one connecting unit; each L-shaped retainer is made of flexible and bendable materials. When the umbrella is folded, by the clamping effect of the two L-shaped retainers of one connection portion, the umbrella cloth will present a smooth folded shape with an apparent folding angle so that the umbrella cloth can be folded along the umbrella pole easily and rapidly.

In the present invention, every two adjacent L-shaped retainers are formed as a connection portion therebetween. Furthermore, two adjacent sides of two adjacent L-shaped retainers are approximately parallel; and the connecting unit runs across the two adjacent L-shaped retainers. Moreover, the connecting unit runs across two respective sides of two L-shaped retainers which are not arranged nearby. Further two sides of the two L-shaped retainer are overlapped so that the combination of two L-shaped retainers is formed as a Y shape or a T shape.

The various objects and advantages of the present invention will be more readily understood from the following detailed description when read in conjunction with the appended drawing.

BRIEF DESCRIPTION OF THE DRAWINGS

FIG. 1 shows the structure of the present invention.

FIG. 1-1 is an exploded perspective view of the connection portion of the present invention.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 2:
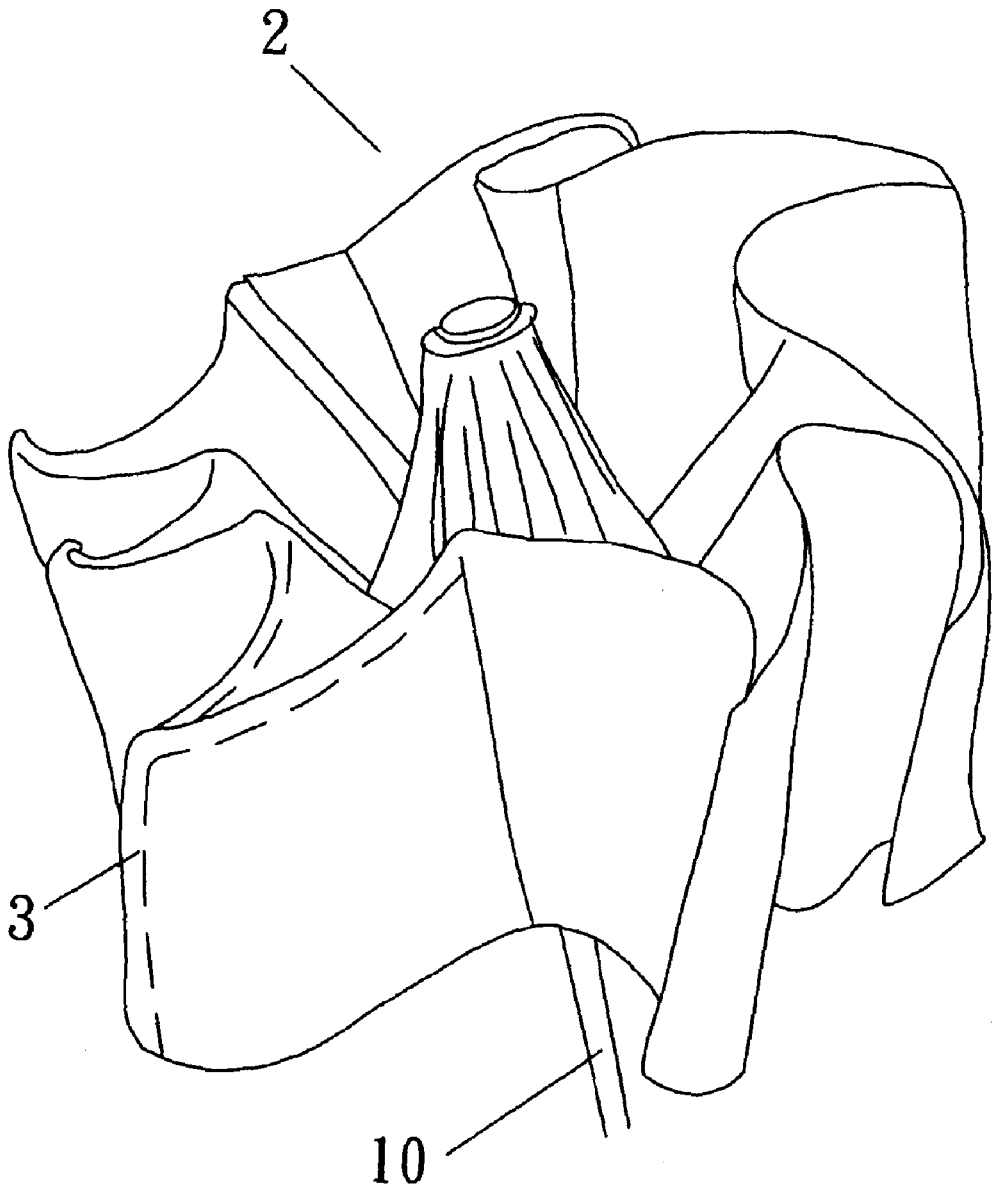
FIG. 2 shows an intermediate state of the umbrella of the present invention as folding it.
Figure 3:
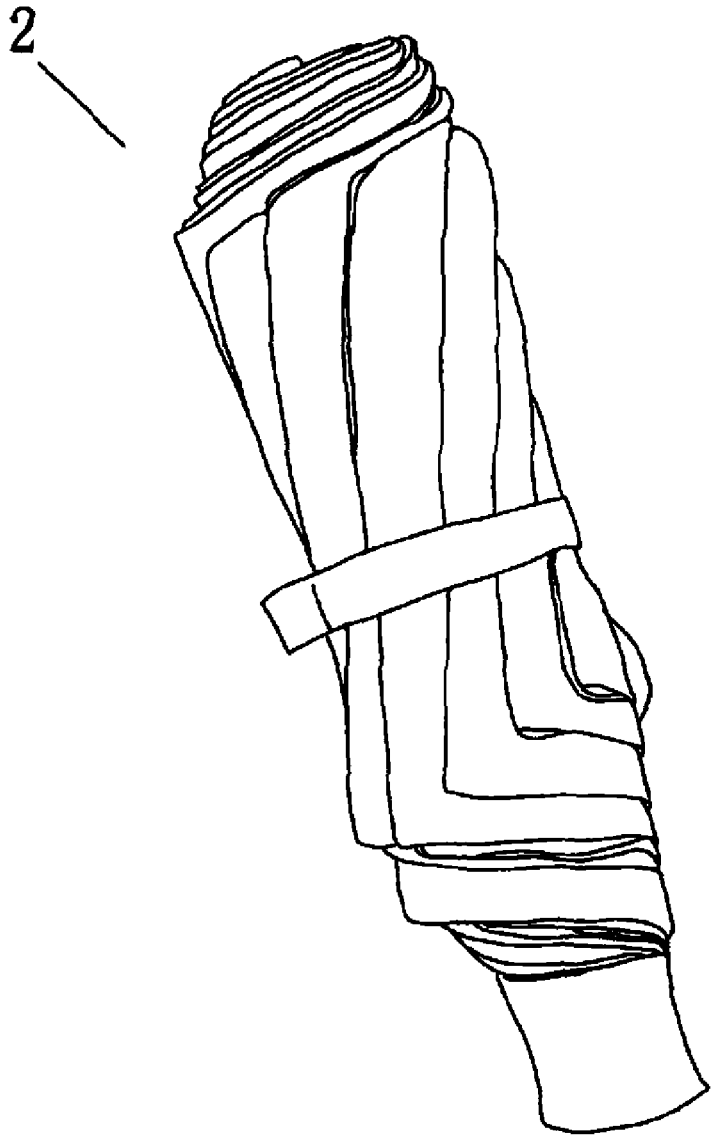
FIG. 3 shows the complete state of the umbrella of the present invention as it is folded.

A foldable umbrella 100 of the present invention is illustrated in FIGS. 1 to 3. The umbrella 100 includes the following elements.

A plurality of foldable ribs 1 are included.

An umbrella pole 10 serves for connecting the ribs 1. One ends of ribs 1 are connected to one end of the umbrella pole 10 and are expanded from the umbrella pole 10 along a radiating path.

An umbrella cloth 2 is connected upon the ribs 1 to be formed with an approximate regular polygon for sunlight and rain shielding.

At least one connection portion connection portion is located on an inner side of the umbrella cloth 2 and is connected between two adjacent ribs 1. FIGS. 1-1 shows an exploded view of the connection portion according to the present invention.

Each connection portion includes two L-shaped retainers 3 and one connecting unit 300. One sides of the two L-shaped retainers 3 of one connection portion are approximately parallel to one another. Preferably, the connecting unit 300 runs across two sides of the two L-shaped retainers 3 which are not arranged nearby. Preferably, each connecting unit 300 is made of flexible and elastic materials, such as elastic bands. Preferably, the two approximately parallel sides of the two L-shaped retainers of one connection portion are arranged along two respective adjacent ribs 1 so that all the parallel sides of the L-shaped retainers 3 are formed as an approximate radiation shape. In the present invention, each L-shaped retainer 3 is adhered to the umbrella cloth 2 by gluing or seaming. It should be noted that the L-shaped retainer 3 may have a shape approximately similar to a L shape and is made of flexible materials, such as plastics.

Preferably, every two adjacent ribs 1 has a connection portion therebetween.

Referring to FIGS. 2 and 3, the use of the present invention is illustrated. In the present invention, when the user folds the umbrella, by the clamping and shape effect of the two L-shaped retainers 3, the umbrella cloth 2 will present an apparent folding edge and a smooth outlook so that the umbrella cloth 2 is folded along the umbrella pole 10 easily.

Thus the umbrella cloth 2 can be folded easily, rapidly, and directly with a beautiful outlook and a small size. It is difficult to be damaged.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable umbrella capable of auto-adjustment of the umbrella cloth, comprising:

a plurality of foldable ribs;

an umbrella pole for connecting one ends of the ribs;

an umbrella cloth expanded along a space spanned by the ribs;

at least one connection portion located on an inner side of the umbrella cloth and between two adjacent ribs; and wherein each connection portion includes two approximate L-shaped retainers and one connecting unit; and each approximate L-shaped retainer is made of flexible and bendable materials;

wherein when the umbrella is folded, by the clamping of the two approximate L-shaped retainers of one connection portion, folding portions of the umbrella cloth will present a predetermined shape with an angle causing the umbrella to have apparent folding edges, the umbrella cloth will present a smooth folded shape so that the umbrella cloth can be folded along the umbrella pole easily and rapidly.

2. The foldable umbrella as claimed in claim 1, wherein the umbrella pole connects one ends of the ribs so that the ribs are formed as an approximate radiated shape.

3. The foldable umbrella as claimed in claim 1, wherein the umbrella pole for connecting one ends of the ribs so that the ribs are formed as an approximate regular polygon for rain and sunlight shielding.

4. The foldable umbrella as claimed in claim 1, wherein the connecting unit is made of flexible and elastic materials.

5. The foldable umbrella as claimed in claim 1, wherein two adjacent sides of the two L-shaped retainers are expanded outwards along a center of the umbrella cloth to an outer edge of the shielding cloth so that all the L-shaped retainers are formed as an approximate radiating form as that of the ribs.

6. The foldable umbrella as claimed in claim 1, wherein each L-shaped retainer is seamed or glued to an inner side of the umbrella cloth.

7. The foldable umbrella as claimed in claim 1, wherein every two adjacent ribs has a connection portion therebetween.

8. The foldable umbrella as claimed in claim 1, wherein two adjacent sides of two adjacent L-shaped retainers are approximately parallel; and the connecting unit runs across the two adjacent L-shaped retainers.

9. The foldable umbrella as claimed in claim 1, wherein the connecting unit runs across the two L-shaped retainers on respective sides which are not against the other L-shaped retainers.

10. The foldable umbrella as claimed in claim 1, wherein two sides of the two L-shaped retainer are overlapped so that the combination of two L-shaped retainers is formed as an approximate Y shape or an approximate T shape.

* * * * *